US005099776A

United States Patent [19]

Jimenez et al.

[11] Patent Number: 5,099,776

[45] Date of Patent: Mar. 31, 1992

[54] ZIG-ZAG NEEDLE BAR BEARING UNIT

[75] Inventors: Antonio Jimenez, Meyrin; Michel Combepine, Les Avanchets, both of Switzerland

[73] Assignee: Mefina S.A., Switzerland

[21] Appl. No.: 443,170

[22] Filed: Nov. 30, 1989

[30] Foreign Application Priority Data

Nov. 30, 1988 [CH] Switzerland ..... 4439/88

[51] Int. Cl.[5] ..... D05B 3/02

[52] U.S. Cl. ..... 112/443; 112/221

[58] Field of Search ..... 112/443, 444, 459, 460, 112/157, 464, 465, 221, 462, 80.41, 103, 310, 448, 449, 259, 256, 467

[56] References Cited

U.S. PATENT DOCUMENTS

| | | | |
|---|---|---|---|
| 2,862,468 | 12/1958 | Johnson | 112/158 |
| 2,932,268 | 4/1960 | Johnson | 112/221 |
| 2,989,016 | 6/1961 | Johnson | 112/158 |
| 3,026,831 | 3/1962 | Johnson | 112/221 |
| 3,518,954 | 7/1970 | Blackwood et al. | 112/449 |
| 4,000,706 | 1/1977 | Kreissl et al. | 112/221 |
| 4,191,119 | 3/1980 | Arvai | 112/259 |
| 4,213,409 | 7/1980 | Ross | 112/158 R |
| 4,215,638 | 8/1980 | Johnson | 112/221 |
| 4,458,611 | 7/1984 | Arendash | 112/158 R |
| 4,873,932 | 10/1989 | Adams | 112/443 |
| 4,895,090 | 1/1990 | Adams et al. | 112/221 |

FOREIGN PATENT DOCUMENTS

| | | | |
|---|---|---|---|
| 0233307 | 8/1987 | European Pat. Off. | 112/157 |
| 0881686 | 5/1943 | France . | |
| 1103547 | 9/1976 | Japan . | |
| 1103548 | 9/1976 | Japan . | |

*Primary Examiner*—Werner H. Schroeder
*Assistant Examiner*—Ismael Izaguirre
*Attorney, Agent, or Firm*—Cushman, Darby & Cushman

[57] ABSTRACT

In a sewing machine, a needle-bar is slidingly mounted in two bearings, the external surface of each of which has a spherical profile. The bearings are pivotably engaged in respective seats of complementary profile provided in a fixed support, for an upper bearing, and in a movable lever, for a lower bearing. This lever is alternately pivoted into two opposite positions under the action of a stepper motor. The motor drives the movable lever by engagement of a pinion with peripheral gear teeth carried by the movable lever.

The motor, the fixed support, the movable lever, the bearings and the needle bar form a self-contained and detachable assembly.

9 Claims, 5 Drawing Sheets

FIG. 7
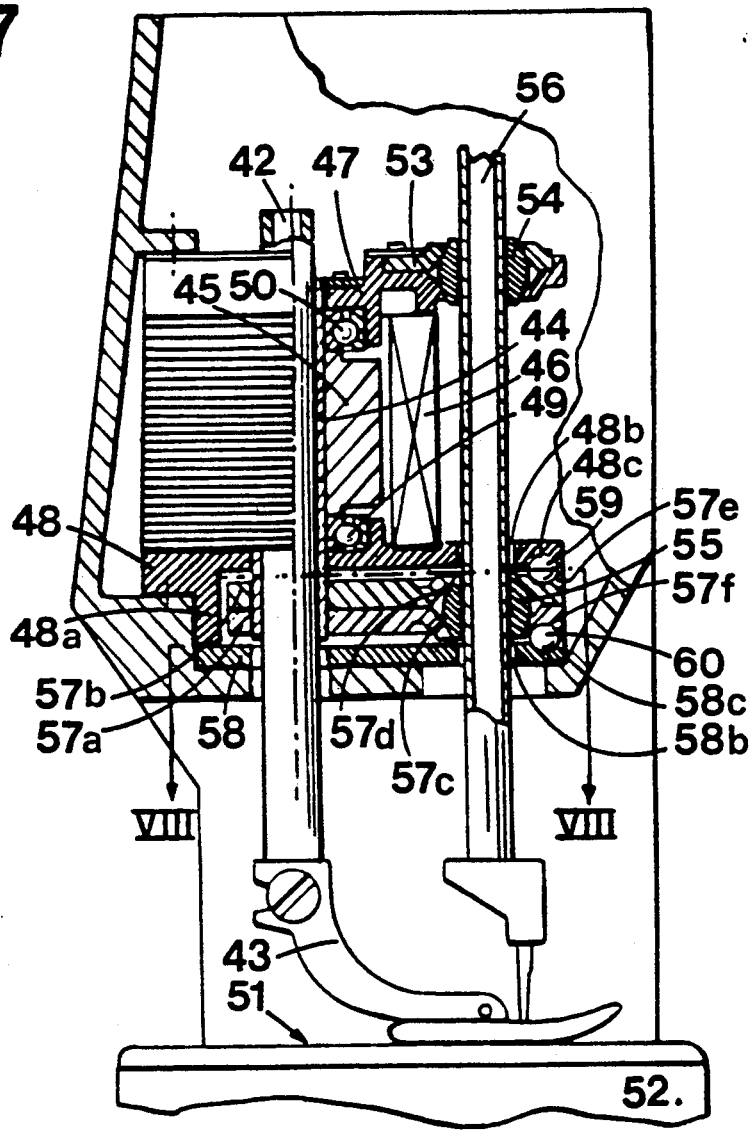
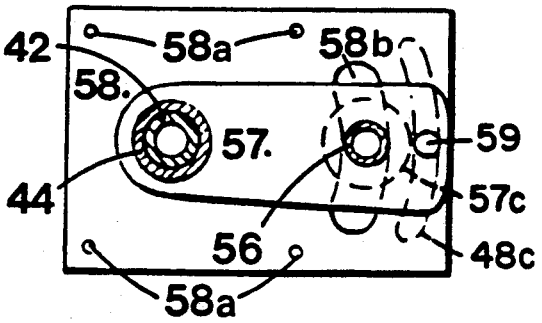
FIG. 8

FIG.9
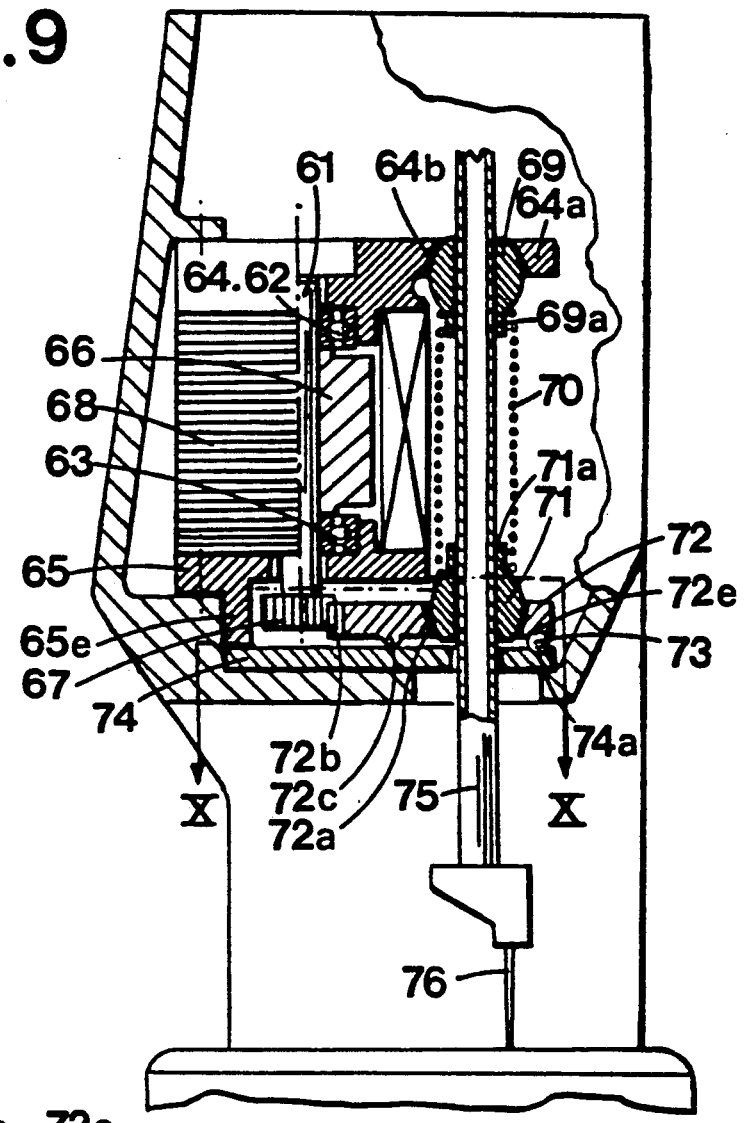
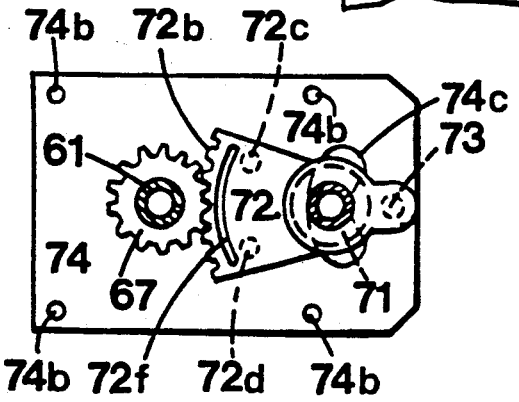
FIG.10

ZIG-ZAG NEEDLE BAR BEARING UNIT

BACKGROUND OF THE INVENTION

1. Description of the Related Art

Numerous zig-zag sewing machines are known in which the stitching action of the needle is obtained by a swinging movement of the needle bar.

In some of these machine, the needle bar is slidingly mounted in a cradle pivoted to the frame of the machine at an intermediate point on its length and the upper end of the needle bar is subjected to the action of a control device which imposes on it a reciprocating displacement of an amplitude characteristic of that desired for the stitching movement of the needle. Swiss Patent No. 458,899 and the Japanese Kokai 51-103,547 and 51-103,548 describe precisely structures of this type.

In other sewing machines, such as those disclosed by U.S. Pat. Nos. 4,215,638 and 4,458,611, the needle bar is similarly associated with a cradle subjected to a swinging movement, but this is fixed to the frame of the machine by two universal joints, the first of which is near the upper end of the cradle and the second, which is situated at the level of the lower part of the sewing head, is generally mounted on a lever support, itself pivoted on the frame of the machine.

In a third type of sewing machine shown in particular by the Patents FR 881,686, U.S. Pat. Nos. 2,862,468, 2,932,268, 2,989,016 and 4,213,409, the sewing machine no longer comprises, strictly speaking, a cradle, the needle bar being slidingly mounted in two bearings associated respectively with a first fixed support, for the one, and with a second support, displaceable transversely to the longitudinal axis of the needle bar, for the other, these bearings being fixed to the respective support by connecting members which assure them individually, displaceability with respect to their support in at least two orthogonal directions.

In the machine of the French document cited hereinabove, the connecting members in question are formed by sorts of universal joints fixed between the bearing and a portion of the casing of the machine, for the upper bearing, and, for the lower bearing, between this bearing and the end of a translational control rod extending within the upper arm of the machine as far as a drive mechanism situated in the vertical housing of the frame.

In the machines described in the last four U.S. Patents cited, the external surface of the bearings has a spherical profile by which they are pivotingly engaged in corresponding seats of complementary shape, associated with a lever support pivoted on the frame of the machine, for the upper bearing, and integral with the frame, for the lower bearing. The stitching movement of the needle bar is obtained by alternate tilting of the upper lever.

Whatever the structure of the swinging needle bar sewing machines adverted to hereinabove, this structure is heavy and complex; it is a question, in effect, of mechanically controlled machines in which the stitching movement of the needle bar is obtained by the operation of linkage systems and mechanical mechanisms responsible for transforming the movement, which is initially rotational, of a drive device, into axial displacements of adjustable amplitude according to the amplitude desired for the stitching movement of the needle bar.

Constructions of this type are however no longer acceptable in modern sewing machines and, in particular, in the electronic machines in which, it is known, an optimum compromise between the overall dimensions of the casing and a reduced weight must be achieved for an increased operational quality. On this latter point, it is to be noted that the natural inertia presented by the known mechanical adaptations representing the state of the art previously adverted to is such that it becomes practically impossible to control the movement with great speed by means of commercial stepper motors without having to oversize these latter and, because of this, also oversizing the frame which must incorporate them.

It is also to be noted that these known adaptations are of a structural complexity unacceptable in this age, as much from the point of view of the manufacture of the parts they contain as, and especially, from the point of view of, on the one hand, their assembly in the factory, and, on the other hand, their repair, and indeed their possible replacement by the retailers.

SUMMARY OF THE INVENTION

The invention proposes precisely to overcome the set of disadvantages hereinabove by the provision of a zig-zag sewing machine, comprising a needle bar capable of sliding in at least two bearings associated respectively with a first fixed support, for one of said at least two bearings, and a second support, displaceable transversely to the longitudinal axis of the needle bar and facing the first support, for another of said at least two bearings, each bearing being mounted on the respective support by means of a connecting member providing the bearing with displaceability with respect to the support in at least two orthogonal directions, at least one motor for controlling driving of the second support in a to-and-from movement to which the stitching movement of the needle bar corresponds, wherein the motor is disposed in proximity to the needle bar, said supports are secured to the body of the motor, and the needle bar, the bearings, their supports, said connecting members and the motor form a self-contained and detachable unit.

BRIEF DESCRIPTION OF THE DRAWINGS

The accompanying drawings illustrate, by way of non-limiting example,

FIG. 7 shows, in vertical section, a "motor, needle bar, bearings, presser foot" unit forming in particular the stitching control mechanism of a sewing machine according to a third embodiment;

FIG. 8 is a view on the line VIII—VIII of FIG. 7;

FIG. 9 shows, in vertical section, a "motor, needle bar, bearings" unit forming the stitching control mechanism of a sewing machine according to a fourth embodiment and;

FIG. 10 is a view on the line X—X of FIG. 9.

DESCRIPTION OF THE PREFERRED EMBODIMENTS

Figure 1:
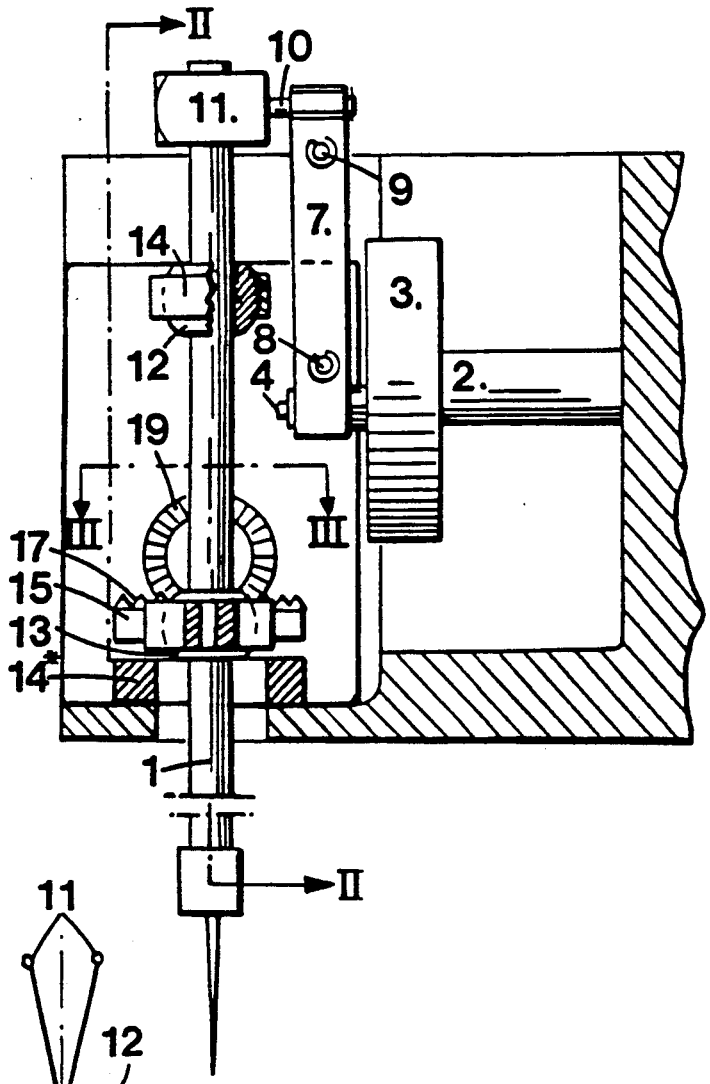
FIG. 1, a side elevation of a first embodiment of the control mechanism for the stitching action of the needle bar of the machine according to the invention.

The sewing machine according to the invention comes within the scope of state of the art machines of the first and of the second types described, in that which concerns the manner of swinging oscillation chosen for the needle bar, and those of the third type, from the point of view of the mechanical structures used, in which the simplicity is found, mutatis mutandis, in the embodiments which will be described hereinafter.

In a first embodiment of the sewing machine according to the invention (FIGS. 1 to 3), the needle bar 1 is driven in its alternate vertical movement by a shaft 2, itself controlled at its right-hand end by a motor, not shown. The left-hand end of the shaft carries a discoidal plate 3 on which there projects out an eccentric pin 4.

One end of a lever 5 (FIG. 2) is pivoted on this pin 4, freely mounted in a rectangular notch 6 at one end of a connecting rod 7. This lever 5 is connected to this connecting rod at its second end which is pivotingly mounted on a pin 8, secured to the connecting rod and extending at right-angles with respect to the previously mentioned pin 4.

A similar arrangement is to be found at the other end of the connecting rod 7 which is provided with a second rectangular notch, not visible in the drawing, but in every respect similar to the notch 6. This second notch embraces a second lever, also not visible, but of identical shape and dimensions to the lever 5, pivoted on the connecting rod 7 by a pin 9, parallel to the pin 8, this second lever carrying a pin 10 extending at right-angles to the pin 9.

This pin 10 is fixed to a stud 11 mounted at the upper end of the needle bar 1.

By virtue of the arrangement which has just been described, it is possible to ensure driving of the needle bar with a vertical movement, irrespective of the inclination of the needle bar, within the usual limits of the stitching displacements in sewing machines. In effect, any inclination of the stud 11 due to a corresponding inclination of the bar 1 will be compensated for by an inclination of the connecting rod 7 made possible by the presence of the pivoted levers connecting it both to this stud and to the plate 3.

The needle bar 1 is slidingly mounted in two bearings 12 and 13, each having a spherical external profile and engaged in seats of complementary shape provided in a fixed support 14, for the first bearing, and, for the second bearing, in a lever 15. One end of lever 15 is pivotingly mounted about a pin 16 carried by a second fixed support 14 . and the upper surface of the other end of lever 15 has a curved toothed portion 17 whose radius of curvature is centered on the pin 16.

The bearings 12 and 13 are preferably of synthetic plastics material of low coefficient of friction but having a good resistance to wear; this material may for example be Teflon or alternatively Delrin (Trade Marks) or also sintered metals. By virtue of the raised capacity for elastic deformation that such materials display, it is in fact possible to introduce these bearings 12 and 13 into their respective seats by driving them in.

Figure 3:
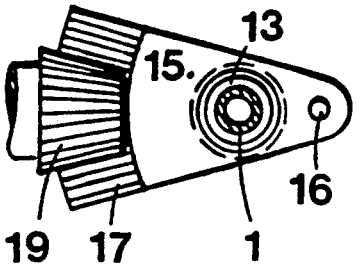
FIG. 3 is a view on the line III—III of FIG. 1.

The supports 14 and 14* are both fixed to the body of a stepper motor which controls the pivoting of the lever 15 by means of a pinion 19 meshing with the toothed sector 17 of this lever (FIG. 3).

It is understood that any angular displacement of the pinion 19 in one direction or in the other will be expressed as a corresponding tilting of the needle bar. With reference to FIG. 1, this tilting will take place towards the right, if the pinion 19 is driven in the counterclockwise direction; it will take place in the opposite direction for an angular displacement of the pinion 19 opposite to the foregoing.

Figure 2A:
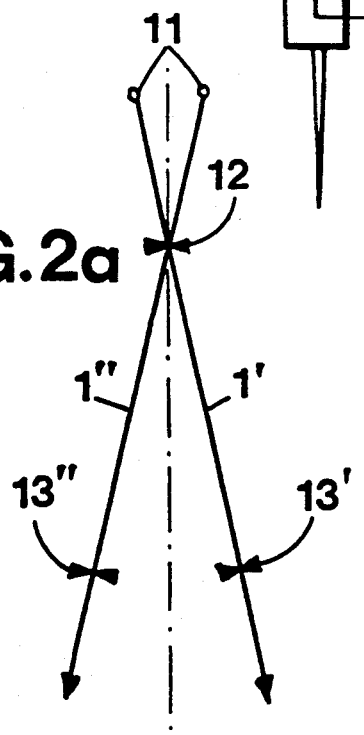
FIG. 2A, a schematic view illustrating the functioning of this embodiment.

The needle bar may, in effect, be displaced from its extreme right-hand position 1' (FIG. 2A) to its extreme left-hand position 1", and vice-versa, by corresponding displacement of the bearing 13 from its position 13' to its position 13" and vice-versa.

As may be seen in the drawing, the set of members which has just been described is grouped in an autonomous and thus detachable unit incorporating the motor 18.

Figure 4:
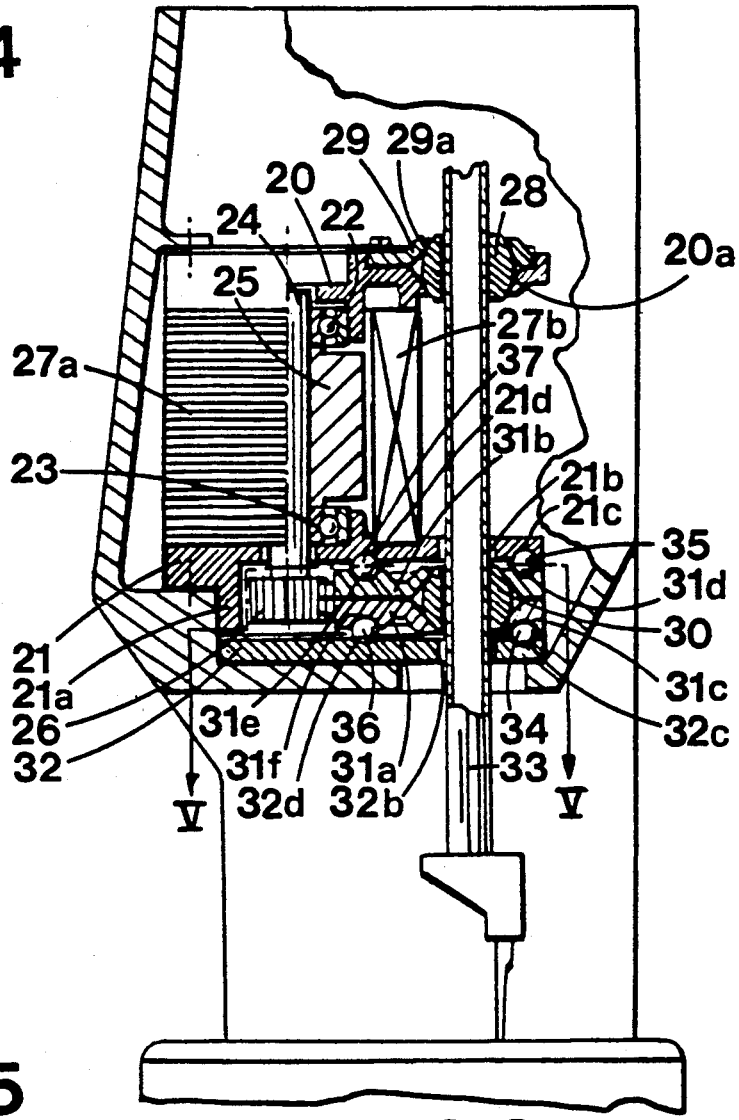
FIG. 4 shows, in vertical section, a "motor, needle bar, bearings" unit forming the stitching control mechanism of a sewing machine according to a second embodiment.
Figure 5:
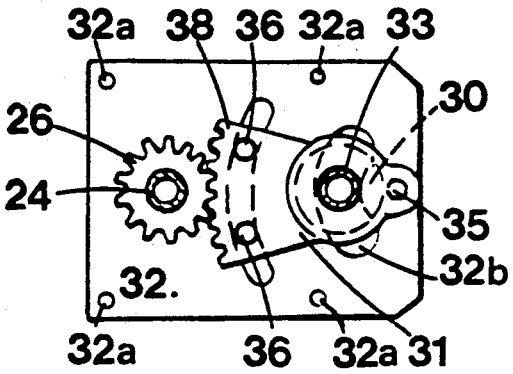
FIG. 5 is a view on the line V—V of FIG. 4.
Figure 6:
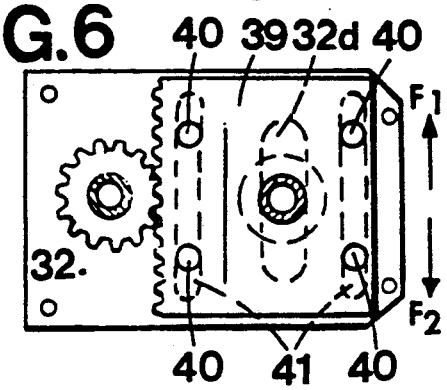
FIG. 6 is a view similar to that of FIG. 5, of a variant.

In the embodiment which is the subject of FIGS. 4 to 6, the "motor, needle bar, bearing" assembly is in the form of a movable assembly, which is of particularly reduced volume and is detachable. This assembly may be manufactured anywhere, independently of the other members forming the sewing machine, and mounted on site with a minimum of adjustments.

In the drawing, the mechanism for driving the needle bar in a vertical movement has not been represented, but it goes without saying that it may be of the type described before without requiring any particular adaptations.

In FIG. 4, there may be recognized, first of all, the stepper motor which comprises, mounted between two end plates, an upper end plate 20 and a lower end plate 21, ball bearings 22 and 23 supporting a vertical shaft 24 to which is fixed, on the one hand, the armature 25 of the motor, and, on the other hand, a pinion 26. Encircling the armature 25 there may be recognized the stack 27*a* of the laminations of the field structure and an excitation coil 27*b*.

The upper end plate 20 extends towards the right, in the drawing (FIG. 4), and has an opening 20*a* of spherical profile forming one of the two seats between which is clasped, by its external surface, also spherical, a first bearing 28 held in position by a cover plate 29, fixed to the end plate 20 and having an opening 29*a*, of spherical profile, situated in line with the opening 20*a* of the end plate, the side wall delimiting the opening 29*a* forming the seat for the bearing 28 in cooperation with the sidewall delimiting the opening 20*a*.

Vertically below this first bearing, the assembly illustrated has a second identical bearing 30, disposed coaxially with the first bearing and held in position by two shells 31*a* and 31*b* forming, on assembly, a lever 31 (FIG. 5). These shells are clasped between the end plate 21 of the motor and a complementary support plate 32, pressing against a flange 21*a* of this end plate only partially visible in FIG. 4, but also extending the length of the longitudinal edges of this plate from this flange as far as its right-hand end in the drawing.

The support plate 32 is fixed to the flange 21*a* by screws, not shown, passing through the openings 32*a*; it also has an oblong window 32*b*, of arcuate profile, situated facing a similar window 21*b* of the end plate 21. These two windows are disposed one above the other and in line with the longitudinal axis of the openings of the bearings 28 and 30. These latter are in effect traversed by the needle bar 33 of the sewing machine whose stepper motor as described must be able to control the stitching movements.

Accordingly the shells 31*a* and 31*b* forming the lever 31 are hollowed out at the right-hand ends of their opposed surfaces to each provide a hemispherical recess, 31*c* and 31*d*, situated in line with one another and in line with corresponding recesses 21*c* and 32*c* respectively, formed in the surfaces facing the plates 21 and 32.

In the spaces formed between the recesses 31*d* and 21*c*, as well as in those delimited by the recesses 31*c* and 32*c*, the assembly described has two balls 34 and 35 forming the pivoting element for the lever 31.

At the end situated opposite to the balls 34 and 35 with respect to the needle bar 33, the plates 21 and 32 are each also hollowed out on their facing surfaces, by a groove 21*d*, 32*d* respectively, of a transverse cross-section having the profile of a circular segment centered on a point of each plate coinciding with the axis of symmetry of the recesses 21*c* and 32*c* already described.

As for the shells 31*a* and 31*b* forming the lever 31, the external surface of each of them is hollowed out by two cavities 31*e*, 31*f* respectively, of spherical shape and opening towards and in line with the grooves 21*d* and 32*d* of the plates 21 and 32. These cavities, whose radius of curvature corresponds to that of the profile of the cross-section of the grooves 21*d* and 32*b*, define seats for two pairs of balls 36 and 37 also engaged in the grooves hereinabove, forming rolling and guide tracks for the lever 31, during its lateral displacements about the axis of pivoting provided by the balls 34 and 35.

This lever 31 is in effect equipped, at its left-hand end, with a toothed circular segment 38, with which the previously mentioned pinion 26 comes in contact.

Thus any angular displacement of this pinion, due to its being driven by the stepper motor, is expressed as a corresponding sidewise movement of the lever 31 about its axis of pivoting (balls 34 and 35) and, as a result, tilting of the needle bar 33 (stitching movement) within the slots 21*b* and 32*b*.

As in the case of the embodiments already described, it will suffice to control the stepper motor with an appropriate pulsed voltage to obtain the carrying-out by the needle bar of a stitching movement of a very precise amplitude, which may, moreover, even be different to each side of the vertical rest position of the needle bar.

In the variant of FIG. 6, the lever 31 has been replaced by a slide block 39 capable of being displaced in opposite directions, $F_1$ and $F_2$, by rolling on balls 40, associated with this sliding block, at the bottom of rectilinear grooves 41 provided in the plates 21 and 32, all of this in the same manner as that which has been described with reference to the embodiment of FIGS. 4 and 5. An oblong slot 32*d*, provided in the support plate 32, allows the needle bar to carry out its stitching movement. This variant is more particularly intended for a sewing machine whose loop pick-up device rotates about a horizontal axis.

In its third embodiment, the sewing machine according to the invention comprises an assembly incorporating a hollow rod 42 forming a support for a presser foot 43 (FIG. 7).

This rod 42 is slidingly mounted inside a tubular shaft 44 forming the shaft of a stepper motor of which 45 is the armature, 46 the winding, and 47 and 48 end plates in recesses of which two roller bearings, 49 and 50, are inserted, the inner cages of which are in contact with the shaft 44.

A spring device, not shown, allows the rod 42 to be displaced vertically with a view to bringing it either into the position illustrated, in which the foot 43 is resiliently applied against the work surface 51 of the lower arm 52 of the machine, or bringing it into an upper position in which the foot 43 is distant from the work surface.

As in the case of the third embodiment (FIG. 4), the upper end plate, 47, of the motor extends towards the right, in the drawing, beyond the winding 46 and forms, in co-operation with an attached plate 53, a seat for a bearing 54 of spherical external profile.

Figure 2:
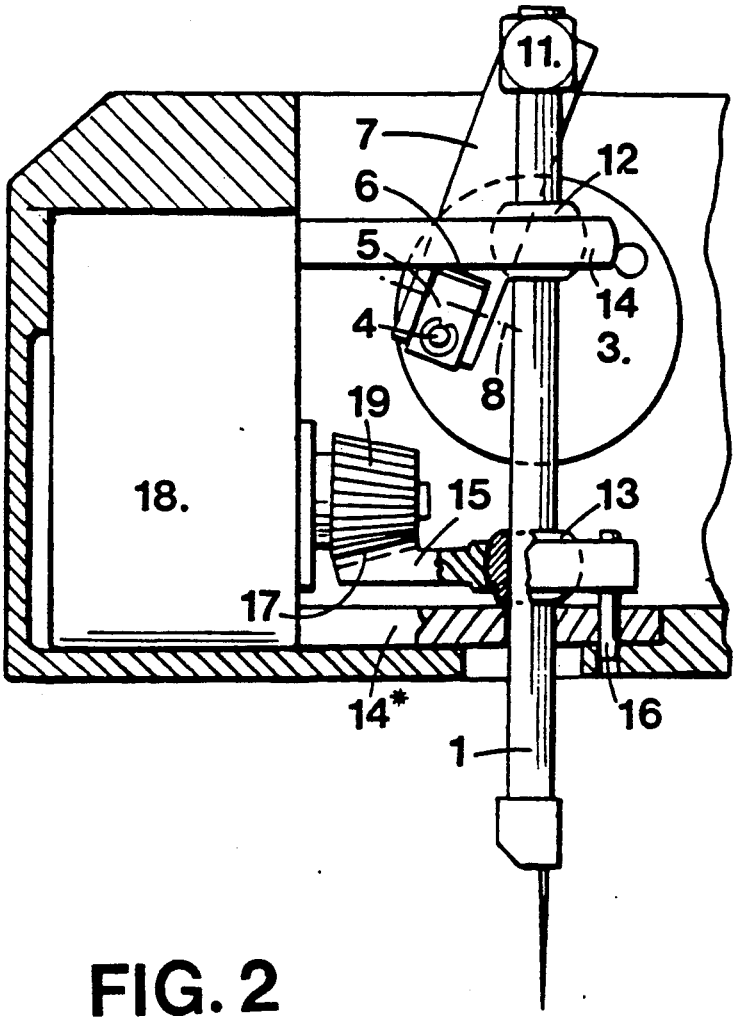
FIG. 2, a view, in part cut away, on the line II—II of FIG. 1.

This bearing is intended to assure, in co-operation with a second bearing 55 of the same type, support and axial guidance of a needle bar 56, which is driven in an alternating vertical movement by a mechanism not shown in the drawing but of the type illustrated in FIGS. 1 and 2, for example.

The bearing 55 is mounted between two shells 57*a* and 57*b* forming a lever 57, the left-hand part (FIG. 7) of which is fixed to the shaft 44 of the stepper motor of the assembly. The right-hand part of the lever has, for each shell, on the one hand, an opening 57*c*, 57*d* respectively, whose edges have a spherical profile complementary to the external profile of the bearing 55 and thus form the seat for this bearing, and, on the other hand, a hemispherical recess 57*e* and 57*f* respectively.

The composite lever 57 is disposed between the end plate 48 and a complementary support plate 58, resting against a flange 48*a* of the end plate 48, a flange which is only partially visible in FIG. 7, but which also extends along the length of the longitudinal edges of the end plate 48, as far as the right-hand end of this, in the drawing.

The support plate 58 is fixed on the flange 48*a* by screws, not shown, traversing holes 58*a*; it also has a window 58*b*, of arcuate profile, centered on the axis of the needle bar 56, a window which is situated facing a similar window 48*b* of the end plate 48. These two windows are superpositioned and their length corresponds to the maximum amplitude of the stitching movement desired for the needle bar 56 which passes through them.

The plates 48 and 58 each comprise finally, on their facing surfaces and at a distance from the axis of the shaft 44 corresponding to the distance separating this axis from the hemispherical recesses 57*e* and 57*f* of the shells 57*a* and 57*b* of the lever 57, an oblong groove of semi-circular cross-section, 48*c*, 58*c* respectively, and of arcuate profile, centered on the axis of the needle bar 56.

Balls 59 and 60 are disposed in the spaces delimited between the recesses 57*e* and 57*f* and the respective grooves 48*c* and 58*c*.

The assembly which has just been described is more particularly intended for a sewing machine whose loop pick-up device is mounted on a vertical axis disposed behind the needle-bar, that is to the left of this in the drawing.

Thus any angular displacement of the armature 45 of the stepper motor will be expressed as a displacement in the same direction and of the same amplitude of the composite lever 57 and, as a result, of the bearing 55, such that the needle-bar 56 will tilt, with respect to its point of pivoting formed by the bearing 54, by an angle characteristic of the angular displacement of the armature.

For every variation in the amplitude and in the direction of this stepper motor armature displacement, there will correspond a proportional modification in the angular position of the needle-bar. Such a variation may be obtained, in a well known manner, by supplying the stepper motor with periodic signals of different polarity and number, according to the direction and amplitude desired for the pendular movement of the needle bar.

In its embodiment shown in FIGS. 9 and 10, the assembly comprised in the sewing machine according to the invention has a generally simplified and particularly functional structure.

There is to be found the stepper motor comprising a shaft 61 mounted on two ball bearings 62 and 63, between two end plates 64 and 65, and carrying the armature 66 of the, motor as well as, at its lower end, a pinion 67. The field structure 68 is represented, to the left of the shaft 61, by its stack of stator laminations and, to the right, by one of its coils.

The end plate 64 extends towards the right, beyond the winding 68, to form a extention opening **64*b* of frustoconical profile, which narrows as it tapers towards the top of the Figure and forms a seat for the external spherical surface of a bearing 69 held in this opening by a vertical spring 70 engaged, at its upper end, on a neck 69*a* projecting out from the lower part of the bearing 69, and, at its lower end, on a neck 71*a* of the upper part of a second bearing 71, identical with the bearing 69 and resting on a seat formed by an opening 72*a*, of frustoconical profile, provided in a horizontal lever 72**. This profile narrows while tapering towards the bottom of the Figure.

The lever 72 is in the general form of a sector of a circle, toothed at **72*b*, in contact with the pinion 67 and seated on the upper surface of a complementary support plate 74, on the one hand by means of two hemispherical projections 72*c* and 72*d*, and on the other hand, by means of a ball 73, engaged both in a hemispherical recess 72*e* of the lever and in a hemispherical recess 74*a* of the support plate 74. A slot 72*f* extending near to the teeth 72*b*, ensures a resilient contact, without play and damped, between the pinion 67** and the teeth themselves.

The support plate 74 is fixed on a flange **65*e* of the end plate 65, of which only a portion is visible in the drawing, but which extends also along the longitudinal edges of the end plate, as far as its right-hand end. This mounting is carried out by means of screws, not shown, passing through the apertures 74*b*** and engaged in corresponding threaded holes provided in the flange.

A window **74*c*, of arcuate shape, allows vertical passage and lateral movement of a needle bar 75 slidingly mounted in the bearings 69, 71**.

In effect, the ball 73 defines an axis of pivoting for the lever 72, which may thus be pivoted in the clockwise and anticlockwise directions by corresponding angular displacement of the armature 66 of the stepper motor, in each case in an opposite direction to the direction of pivoting of the lever 72. Accordingly it is possible to drive the needle-bar in a pendular movement about an upper pivot point defined by the bearing 69 and to thus obtain the stitching action of the needle 76 carried by the needle bar 75. The pendular movement in question will of course be of an amplitude programmed by sending to the stepper motor voltage pulses of number and polarity dependant on the type of stitches to be sewn.

Furthermore, by virtue of the force exerted by the spring 70 on the bearing 71 and transmitted by this to the lever 72, this lever is assured of being permanently kept in the correct position on the support plate 74, by the pressing of the projections **72*c* on this support plate, on the one hand, and by engagement of the ball 73 both in the recess 74*a* of the support plate and in the recess 72*e* of the lever 72**, on the other hand, without requiring the intervention of other retaining members.

Thus as may be seen in the drawing, the assembly described is formed of a reduced number of pieces, easy to mount: it suffices in effect, to start by mounting the complementary support plate 74 on the flange **65*e* of the end plate 65 of the stepper motor, then to place the lever 72 on the support plate 74 while putting its teeth 72*b* into engagement with the pinion 67 secured to the shaft of the motor, and to also insert the ball 73 into the space delimited by the recess 72*e* of the lever and the recess 74*a* of the end plate 74**.

There are then mounted, separately, two bearings, such as those indicated by the references 69 and 71, at the two ends of a spring, such as the spring 70, while engaging the necks **69*a*, 71*a*** respectively of the bearings in the first opening of the end of the spring and in its second end opening, respectively.

The entire assembly is compressed axially until its length becomes slightly less that the distance separating the lower surface of the extension **64*a* of the end plate 64 of the motor and the upper surface of the lever 72 so that this assembly may be passed between these members (end plate 64 and lever 72), and the bearings 69 and 71 are brought towards the seats 64*b* and 72*a*** provided respectively in this end plate and in this lever.

The spring 70 is allowed to relax so that the bearings engage in the seats hereinabove.

Finally the needle bar 75 is introduced through the opening of the first bearing (69 or 71), then through the spring 70, and finally into the opening of the second bearing, by axial sliding of the needle bar in these bearings.

By this operation there is obtained an absolutely correct self-centering of the bearings 69 and 71 in their respective seats and thus a perfect positioning of the needle bar with respect to the other parts of the assembly, which is thus ready to be mounted in the body of the sewing machine.

The invention is not limited to that which has been described or illustrated; in particular, the spring 70 of the embodiment of FIG. 9 may very well be replaced by a resilient member of another kind. It may, in particular, be a prestressed resilient leaf, having for example for form of a V, with the ends of its arms acting against the blocks 69 and 71 respectively.

We claim:

1. A zig-zag sewing machine, including a sewing head comprising an autonomous unit including:

first and second bearings, each having a passage, a needle bar mounted to slide in said passage of said first and second bearings, a first and second support, a first ball-and-socket joint connecting said first bearing to said first support, a second ball-and-socket joint connecting said second bearing to said second support, means for driving said needle bar in an axial, bidirectional movement by sliding in said passages of said bearings, means for guiding said second support along a path transverse to that taken by said needle bar in said axial movement and including means for controlling and limiting displacement of said second support relative to said first support, means, including a control motor having a rive shaft operatively engaged with said second support, for driving said second support along said transverse path, in an alternatingly back-and-forth movement, corresponding to a periodic lateral displacement of the needle bar, and means interconnecting said first and second supports and said control motor so that said supports and said drive shaft are in a predetermined relative disposition.

2. A zig-zag sewing machine, including a sewing head comprising an autonomous unit including:

first and second bearings, each having a passage, a needle bar mounted to slide in said passage of said fist and second bearings, a first and second support, a first ball-and-socket joint connecting said first bearing to said first support, a second ball-and-socket joint connecting said second bearing to said second support, means for driving said needle bar in an axial, bidirectional movement by sliding in said passages of said bearings, means for guiding said second support along a path traverse to that taken by said needle bar in said axial movement and including means for controlling and limiting displacement of said second support relative to said first support, means, including a control motor having a drive shaft operatively engaged with said second support, for driving said second support on said transverse path, in an alternatingly back-and-forth movement, corresponding to a periodic lateral displacement of the needle bar, means interconnecting said first and second supports and said control motor so that said supports and said drive shaft are in a predetermined relative disposition, wherein said first and second bearings, respectively, are formed by a first and second body, each traversed by said passage, and wherein said first and second joint, respectively, include:

at least one first contact face formed by an outer face of said first and second body, respectively, and said first or second body having a profile corresponding to that of a lateral surface of an annular segment of a sphere centered at a point on a longitudinal axis of each of said passages, associated with said first and second supports, respectively, at least one seat is provided for forming a second contact face of said first and second body, respectively, each seat having a profile corresponding at least in part to that of said first and second contact faces of said bodies, respectively, and means holding the body of each bearing in contact with the respective seat, regardless of the position occupied by the needle bar during a zig-zag operation.

3. The machine of claim 2, wherein said second support comprises a lever guidingly movable within a cage attached to said control motor, and one end of said lever has teeth having a profile of an arc of a circle centered on a pivot point of said lever, one end of said drive shaft having a pinion engaging said teeth of said lever.

4. The machine of claim 2, wherein said first support is formed by an assembly of a first and second shell each having a first face and a second face, each shell having a wall being traversed by an opening, the cross section of the opening having a size which is increasing from the first face to the second face of the respective shell, said first and second shells facing one another by their respective second face and said openings communicating with one another at a section of the assembly having maximum size and defining between the first and second shells a receptacle for said first body of said first bearing, an annular portion of a lateral face of said receptacle forming said seat, wherein holding means hold said first and second shells in an assembled position.

5. The machine of claim 2, wherein said second support is formed by an assembly of first and second shells, each having a first face and a second face, each shell having a wall being traversed by an opening, the cross section of the opening having a size which is increasing from the first face to the second face of the respective shell, said shells facing one another by their respective second face and said openings communicating with one another at a section of maximum size and defining between said shells a receptacle for said second body of said second bearing, an annular portion of a lateral face of said receptacle forming said seat of said second body, wherein holding means hold said shells in an assembled position, and wherein said second support is disposed between a first and a second wall of a cage attached to the control motor, said first and second walls of the cage being parallel to one another, each wall having a window facing each said opening of said shells, said windows being spaced from and parallel to each other and traversed by said needle bar during a zig zag motion and said first and second walls comprising, respectively, an oblong slot, each having a width greater than a diameter of the needle bar and a length and profile corresponding substantially to a zig zag path taken by said needle bar in said periodic lateral sewing displacement, wherein said shells are held in an assembled position between said first and second walls of said cage by at least one ball, interposed between said shells and said walls, respectively, each ball engaging a groove hollowed out in each said shell and a groove hollowed out in each said wall of the cage, said shell grooves being spaced from and parallel to respective wall grooves, one another as a pair, each pair of grooves facing one another two-by-two, having a profile corresponding to that of said path of the needle bar.

6. The machine of claim 2, wherein said second support is formed by an assembly of first and second shells, each having a first face and a second face, each shell having a wall being traversed by an opening, the cross section of the opening having a size which is increasing from the first face to the second face of the respective shell, said shells facing one anther by their respective second face and said openings communicating with one another at a section of maximum size and defining between said shells a receptacle for said second body of said second bearing, an annular portion of a lateral face of said receptacle forming said seat of said second body, wherein holding means hold said shells in an assembled position, and wherein said second support is disposed between a first and a second wall of a cage attached to the control motor, said first and second walls being parallel to one another, each wall having a window facing each said opening of said shells, said windows being traversed by said needle bar and said first and second walls comprising, respectively, an oblong slot each having a width grater than a diameter of the needle bar and a length and profile corresponding substantially to a zig zag path taken by said needle bar in said periodic lateral sewing displacement, wherein said shells are held in an assembled position between said first and second walls of said cage by at least one ball, interposed between said shells and said walls, respectively, each ball engaging a grove hollowed out in each said shell and a groove hollowed out in each said wall of the cage, said shell grooves being spaced from and parallel to respectively wall grooves, one another as a pair, each pair of grooves facing one another two-by-two, having a profile corresponding to that of said path of the needle bar, wherein one end of said drive shaft has a toothed pinion engaging a correspondingly toothed first end portion of said second support, said grooves being disposed between said windows of said walls of said cage, respectively, and on a side of the second support opposing said pinion teeth said second support is pivotally connected to said walls of the cage at a second end portion of said second support situated opposite to said pinion and being adjacent to said windows, said toothed first end portion, grooves and windows each having at profile of an arc of a circle centered at a common pivot point at the second end portion of said second support, a window of the cage providing access for the shaft of the motor.

7. The machine of claim 2, wherein said second support is formed by an assembly of first and second shells, each having a first face and second face, each shell having a wall being traversed by an opening, the cross section of the opening having a size which is increasing from the first face to the second face of the respective shell, said shells facing one another by their respective second face and said openings communicating with one another at a section of maximum size and defining between said shells a receptacle for said second body of said second bearing, an annular portion of a lateral face of said receptacle forming said seat of said second body, wherein holding means hold said shells in an assembled position, and wherein said second support is disposed between a first and a second wall of a cage interconnected with the control motor, said first and second walls being parallel to one another, each wall having a window facing each said opening of said shells, said windows being traversed by said needle bar during a zig zag motion and said first and second walls comprising, respectively, an oblong slot, each having a width greater than a diameter of the needle bar and a length and profile corresponding substantially to a zig zag path taken by said needle bar in said periodic lateral sewing displacement, said shells are held in an assembled position between said first and second walls of said cage by at least one pair of balls, interposed between said shells and said walls, respectively, each pair of balls engaging a groove hollowed out in each said shell and a groove hollowed out in each said wall of the cage, said shell grooves being spaced from and parallel to respective wall grooves, one another as a pair, each pair of grooves facing one another two-by-two, having a profile corresponding to that of said path of the needle bar, wherein one end of said drive shaft has a toothed pinion engaging a correspondingly toothed first end portion of said second support, said grooves, said windows and a profile of said toothed first end portion being rectilinear and parallel to one another.

8. The machine of claim 2, wherein said second support is formed by an assembly of first and second shells, each having a first face and a second face, each shell having a wall being traversed an opening, the cross section of the opening having a size which is increasing from the first face to the second face of the respective shell, said shells facing one another by their respective second face and said openings communicating with one another at a section of maximum size and defining between said shells a receptacle for said second body of said second bearing, an annular potion of a lateral face of said receptacle forming said seat of said second body, wherein holding means hold said shells in an assembled position, and wherein said second support is disposed between a first and a second wall of a cage interconnected with the motor, said first and second walls of the cage being parallel to one another, each wall having a window facing each said opening of said shells, said windows being spaced from and parallel to each other and traversed by said needle bar during a zig zag motion and said first and second walls comprising, respectively, an oblong slot, each having a width greater than a diameter of the needle bar and a length and profile corresponding substantially to a zig zag path taken by said needle bar in said periodic lateral sewing displacement, wherein said shells are held in an assembled position between said first and second walls of said cage by at least one ball, interposed between said shells and said walls, respectively, each ball engaging a groove hollowed out in each said shell and a grove hollowed out in each said wall of the cage, said shell grooves being spaced from and parallel to respective wall grooves, one another as a pair, each pair of grooves facing one another two-by-two, having a profile corresponding to that of said path of the needle bar, said second support being mounted on a first end of said drive shaft, said grooves and said windows each having a profile of an arc of a circle centered on an axis of longitudinal symmetry of said shaft.

9. The machine of claim 2, wherein said second support is formed by an assembly of first and second shells, each having a first face and a second face, each shell having a wall being traversed an opening, the cross section of the opening having a size which is increasing from the first face to the second face of the respective shell, said shells facing one another by their respective second face and said opening communicating with one another at a section of maximum size and defining between said shells a receptacle for said second body of said second bearing, an annular portion of a lateral face of said receptacle forming said seat of said second body, wherein holding means hold said shells in an assembled position, and wherein said second support is disposed between a first and a second wall of a cage interconnected with the control motor, said first and second walls being parallel to one another, each wall having a window facing each said opening of said shells shell and the second wall having a second window facing said fourth opening of said fourth shell, said windows being traversed by said needle bar during a zig zag motion and said first and second walls comprising, respectively, an oblong slot, each having a width greater than a diameter of the needle bar and a length and profile corresponding substantially to a zig zag path taken by said needle bar in said periodic lateral sewing displacement, wherein said shells are held in an assembled position between said first and second walls of said cage by at least one ball, interposed between said shells and said walls, respectively, each ball engaging a groove hollowed out in each said shell and a groove hollowed out in each said wall of the cage, said shell grooves being spaced from and parallel to respective wall grooves, one another as a pair, each pair of grooves facing one another two-by-two, having a profile corresponding to that of said path of the needle bar, said second support being fixed on a first end of said drive shaft, said grooves and said windows each having a profile of an arc of a circle centered on an axis of longitudinal symmetry of said shaft, said drive shaft being hollow and providing an axial passage extending over the entire length of the shaft, and a presser foot bar being mounted to slide in said axial passage.

* * * * *